US009040765B2

(12) United States Patent
Rice

(10) Patent No.: US 9,040,765 B2
(45) **Date of Patent: *May 26, 2015**

(54) METHODS AND APPARATUSES FOR ISOMERIZATION OF PARAFFINS

(75) Inventor: Lynn H. Rice, Denver, CO (US)

(73) Assignee: UOP LLC, Des Plaines, IL (US)

( * ) Notice: Subject to any disclaimer, the term of this patent is extended or adjusted under 35 U.S.C. 154(b) by 249 days.

This patent is subject to a terminal disclaimer.

(21) Appl. No.: 13/434,703

(22) Filed: Mar. 29, 2012

(65) Prior Publication Data

US 2013/0261366 A1 Oct. 3, 2013

(51) Int. Cl.

| | |
|---|---|
| ***C07C 5/13*** | (2006.01) |
| ***C10G 45/60*** | (2006.01) |
| ***C10G 45/58*** | (2006.01) |

(52) U.S. Cl.

CPC ..... *C10G 45/60* (2013.01); *C10G 45/58* (2013.01); *C10G 2300/1081* (2013.01); *C10G 2300/70* (2013.01); *C10G 2300/703* (2013.01)

(58) Field of Classification Search

USPC ..... 208/133, 134, 135, 136, 137, 138, 139, 208/140, 141; 585/734, 741, 742, 747, 748, 585/800, 801, 802, 812, 803, 813, 814, 815

See application file for complete search history.

(56) References Cited

U.S. PATENT DOCUMENTS

| | | | | |
|---|---|---|---|---|
| 2,414,371 | A | 1/1947 | Fragen et al. | |
| 3,903,196 | A | 9/1975 | Kemp | |
| 4,048,251 | A | 9/1977 | Cahn et al. | |
| 4,241,231 | A | 12/1980 | Gibson et al. | |
| 4,275,257 | A | 6/1981 | Hutson, Jr. | |
| 4,680,042 | A | 7/1987 | Mehra | |
| 4,747,933 | A | 5/1988 | Hibbs | |
| 5,326,926 | A * | 7/1994 | Rice | 585/738 |
| 5,382,730 | A | 1/1995 | Breckenridge et al. | |
| 5,705,730 | A * | 1/1998 | Zarchy et al. | 585/738 |
| 5,763,732 | A | 6/1998 | Mariette et al. | |
| 5,792,897 | A | 8/1998 | Rosser, Jr. et al. | |
| 6,248,931 | B1 | 6/2001 | Davis et al. | |

(Continued)

FOREIGN PATENT DOCUMENTS

| | | | |
|---|---|---|---|
| EP | 1792886 | A1 | 6/2007 |
| WO | 2007063279 | A1 | 6/2007 |

OTHER PUBLICATIONS

Burrington, J., et al., "Catalytic isomerization and dechlorination of nonenes," Applied Catalysis A: General, vol. 210, No. 1-2, pp. 193-206; Mar. 9, 2001.

(Continued)

*Primary Examiner* — In Suk Bullock
*Assistant Examiner* — Sharon Pregler

(57) ABSTRACT

Embodiments of methods and apparatuses for isomerization of paraffins are provided. In one example, a method comprises the steps of separating an isomerization effluent into a product stream that comprises branched paraffins and a stabilizer vapor stream that comprises HCl, $H_2$, and $C_6$-hydrocarbons. $C_6$-hydrocarbons are removed from the stabilizer overhead vapor stream to form a HCl and $H_2$-rich stream. An isomerization catalyst is activated using at least a portion of the HCl and $H_2$-rich stream to form a chloride-promoted isomerization catalyst. A paraffin feed stream is contacted with the chloride-promoted isomerization catalyst in the presence of hydrogen for isomerization of the paraffins.

19 Claims, 1 Drawing Sheet

(56) References Cited

U.S. PATENT DOCUMENTS

| | | | | |
|---|---|---|---|---|
| 6,277,945 | B1 | 8/2001 | Hachiya et al. | |
| 7,022,889 | B2 * | 4/2006 | Gillespie et al. | 585/750 |
| 2006/0205990 | A1 | 9/2006 | Rice | |
| 2008/0245704 | A1 | 10/2008 | Nafis et al. | |
| 2008/0275278 | A1 | 11/2008 | Clark | |

OTHER PUBLICATIONS

Fernandez, P. D., et al., "Uop Inc.'S New Once-Through Hydrogen Penex Technology A New Perspective to Light Naphtha Isomerization Economics," National Petroleum Refiners Association, 1988 NPRA Annual Meeting, San Antonio, Texas, Mar. 20-22, 1988, Paper No. AM-88-45, p. 23.

* cited by examiner

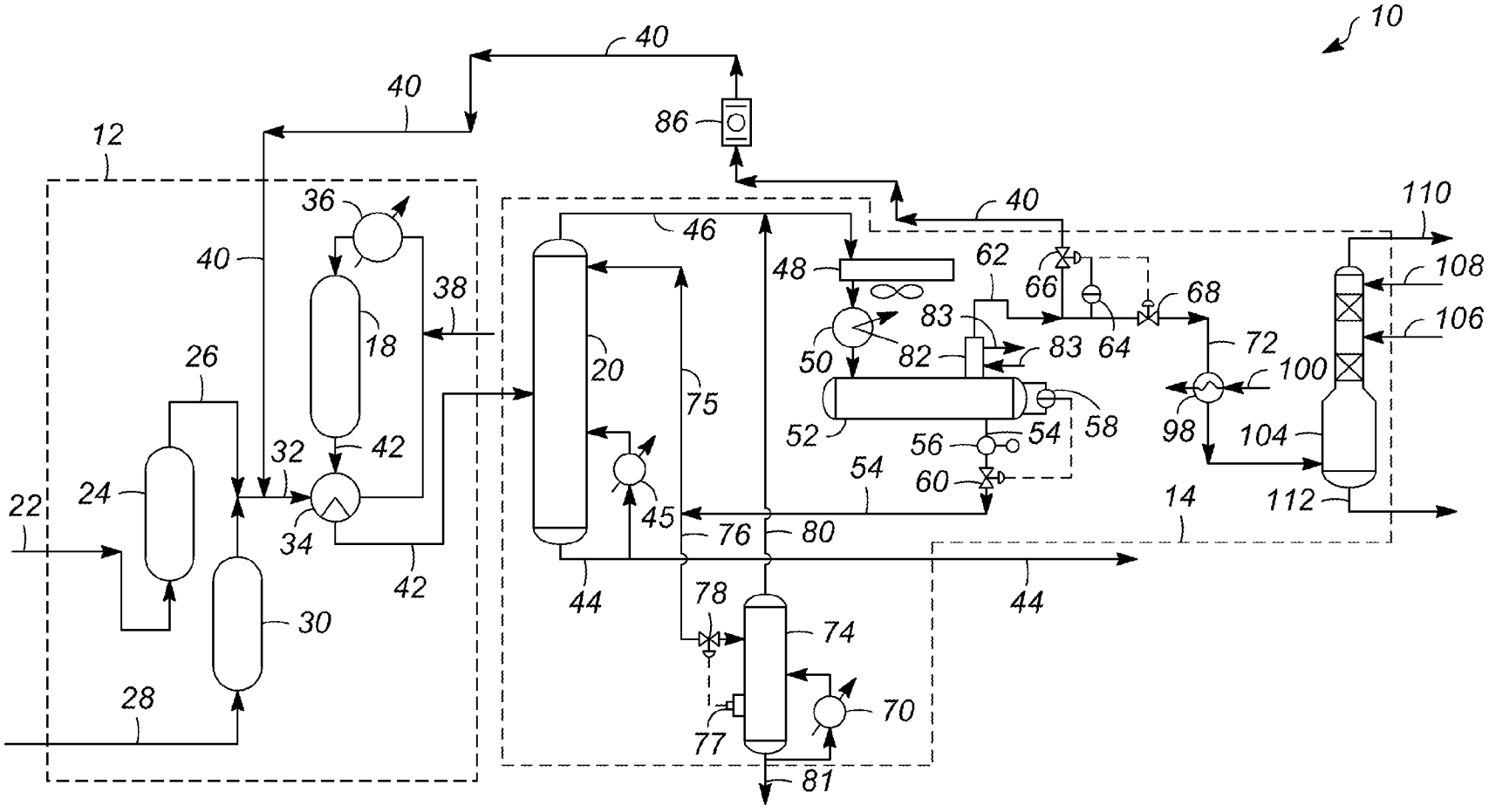
10
110
108
106
100
104
112
72
98
14
68
64
58
66
83
54
62
44
40
83
82
56
60
54
48
50
52
80
70
74
81
86
46
75
76
78
77
45
20
44
40
38
42
18
42
36
34
32
30
40
26
28
12
24
22

METHODS AND APPARATUSES FOR ISOMERIZATION OF PARAFFINS

TECHNICAL FIELD

The present invention relates generally to methods and apparatuses for isomerization of hydrocarbons, and more particularly relates to methods and apparatuses for isomerization of paraffins using a chloride-promoted isomerization catalyst.

BACKGROUND

Isomerization processes are widely used by many refiners to rearrange the molecular structure of straight chain paraffinic hydrocarbons to more highly branched hydrocarbons that generally have higher octane ratings. Many isomerization processes employ a chlorinated catalyst, such as chlorinated alumina catalyst, chlorinated platinum aluminum catalyst, and the like, in a reaction zone. The chlorinated catalyst requires a continuous addition of chloride to replace chloride removed from the surface of the catalyst and carried away in the reaction-zone effluent. Typically, a fresh feed of chloride promoter, such as perchloroethylene, is continuously introduced into a paraffin feed stream upstream from a reactor in the reaction zone. Inside the reactor, the chloride promoter decomposes to form hydrogen chloride that activates, e.g., promotes or regenerates, the catalyst by replenishing the chloride removed from the catalyst's surface.

The reaction-zone effluent generally contains a significant amount of hydrogen chloride from the continuous decomposition of chloride promoter and the removal of chloride from the surface of the catalyst. A product stream containing branched paraffins is separated from the reaction-zone effluent by removing hydrogen chloride and other volatile light hydrocarbons (e.g., hydrocarbons having six or fewer carbons) as a stabilizer vapor stream. Because hydrogen chloride poses environmental and handling concerns, the stabilizer vapor stream is continuously scrubbed with a caustic, such as sodium hydroxide, to neutralize the hydrogen chloride before removing the off-gas stream from the process. The cost of chloride promoters and caustics are relatively expensive, and many refiners would like to reduce their consumption of these components to improve their process efficiencies and reduce overall operational costs.

Accordingly, it is desirable to provide methods and apparatuses for isomerization of paraffins with reduced chloride promoter consumption and/or reduced caustic consumption to improve process efficiencies and reduce overall operational costs. Furthermore, other desirable features and characteristics of the present invention will become apparent from the subsequent detailed description and the appended claims, taken in conjunction with the accompanying drawings and this background.

BRIEF SUMMARY

Methods and apparatuses for isomerization of paraffins are provided herein. In accordance with an exemplary embodiment, a method for isomerization of paraffins comprises the steps of separating an isomerization effluent into a product stream that comprises branched and un-branched paraffins and a stabilizer vapor stream that comprises HCl, $H_2$, and $C_6$-hydrocarbons. A net gas vapor that comprises HCl, $H_2$, and $C_5$-hydrocarbons is formed using the stabilizer vapor stream. The net gas vapor is separated into a $C_5$-hydrocarbons-rich phase and a HCl and $H_2$-rich stream. Forming the net gas vapor comprises separating the stabilizer vapor stream and the $C_5$-hydrocarbons-rich phase into the net gas vapor and a liquid stream that comprises $C_2$- and $C_3^+$ hydrocarbon. An isomerization catalyst is activated using at least a portion of the HCl and $H_2$-rich stream to form a chloride-promoted isomerization catalyst. A paraffin feed stream is contacted with the chloride-promoted isomerization catalyst in the presence of hydrogen for isomerization of the paraffins.

In accordance with another exemplary embodiment, a method for isomerization of paraffins is provided. The method comprises the steps of activating an isomerization catalyst in a reactor operating at isomerization conditions to form a chloride-promoted isomerization catalyst. The isomerization catalyst is activated with HCl generated from a chloride promoter stream and from a HCl and $H_2$-rich recycle stream. A paraffin feed stream comprising un-branched paraffins is contacted with the chloride-promoted isomerization catalyst in the reactor in the presence of hydrogen to form an isomerization effluent that comprises branched paraffins, HCl, $H_2$, and other $C_7$-hydrocarbons. The isomerization effluent is introduced to a stabilizer at stabilization conditions to form a product stream that comprises branched and un-branched paraffins and a stabilizer vapor stream that comprises HCl, $H_2$, and $C_6$-hydrocarbons. A net gas vapor that comprises HCl, $H_2$, and $C_5$-hydrocarbons is formed in a separator at first separation conditions using the stabilizer vapor stream. The net gas vapor is separated in a chiller at second separation conditions into a $C_5$-hydrocarbons-rich phase and a HCl and $H_2$-rich stream. Forming the net gas vapor comprises separating the stabilizer vapor stream and the $C_5$-hydrocarbons-rich phase in the separator at the first separation conditions into the net gas vapor and a liquid stream that comprises $C_2$- and $C_3^+$ hydrocarbons. At least a portion of the HCl and $H_2$-rich stream is recycled back to the reactor as the HCl and $H_2$-rich recycle stream.

In accordance with another exemplary embodiment, an apparatus for isomerization of paraffins is provided. The apparatus comprises a stabilizer that is configured to receive an isomerization effluent and to operate at stabilization conditions effective to separate the isomerization effluent into a product stream that comprises branched and un-branched paraffins and a stabilizer vapor stream that comprises HCl, $H_2$, and $C_6$-hydrocarbons. A separator is configured to receive the stabilizer vapor stream and to operate at first separation conditions effective to form a net gas vapor that comprises HCl, $H_2$, and $C_5$-hydrocarbons using the stabilizer vapor stream. A chiller is configured to receive the net gas vapor and to operate at second separation conditions effective to separate the net gas vapor into a $C_5$-hydrocarbons-rich phase and a HCl and $H_2$-rich stream. The separator is further configured to receive the $C_5$-hydrocarbons-rich phase and to separate the stabilizer vapor stream and the $C_5$-hydrocarbons-rich phase at the first separation conditions into the net gas vapor and a liquid stream that comprises $C_2$- and $C_3^+$ hydrocarbons. A reaction zone contains an isomerization catalyst. The reaction zone is configured to receive at least a portion of the HCl and $H_2$-rich stream and a paraffin feed stream and to operate at isomerization conditions to activate the isomerization catalyst to form a chloride-promoted isomerization catalyst for contact with the paraffin feed stream in the presence of hydrogen for isomerization of the paraffins. A LPG stripper is configured to receive at least a portion of the liquid stream and to operate at third separation conditions effective to separate the at least the portion of the liquid stream into a $C_2$-hydrocarbon-rich stream and a LPG stream that comprises $C_3$ and $C_4$ hydrocarbons.

BRIEF DESCRIPTION OF THE DRAWINGS

The present invention will hereinafter be described in conjunction with the following drawing figures, wherein like numerals denote like elements, and wherein:

FIG. 1 schematically illustrates an apparatus and method for isomerization of paraffins in accordance with an exemplary embodiment.

DETAILED DESCRIPTION

The following Detailed Description is merely exemplary in nature and is not intended to limit the invention or the application and uses of the invention. Furthermore, there is no intention to be bound by any theory presented in the preceding background or the following detailed description.

Various embodiments contemplated herein relate to methods and apparatuses for isomerization of paraffins. Unlike the prior art, the exemplary embodiments taught herein introduce an isomerization reaction-zone effluent from an isomerization reaction zone to a stabilizer. As used herein, the term "zone" refers to an area including one or more equipment items and/or one or more sub-zones. Equipment items can include one or more reactors or reactor vessels (e.g., reaction zone), heaters, exchangers, pipes, pumps, compressors, and controllers. Additionally, an equipment item, such as a reactor, dryer, or vessel, can further include one or more zones or sub-zones. The isomerization reaction-zone effluent comprises HCl, $H_2$, branched and un-branched paraffins, and other $C_7$-hydrocarbons. As used herein, $C_x$ means hydrocarbon molecules that have "X" number of carbon atoms, $C_x$+ means hydrocarbon molecules that have "X" and/or more than "X" number of carbon atoms, and $C_x$− means hydrocarbon molecules that have "X" and/or less than "X" number of carbon atoms. The stabilizer is operating at stabilization conditions effective to separate the isomerization reaction-zone effluent into a product stream that comprises the branched and un-branched paraffins and a stabilizer vapor stream that comprises HCl, $H_2$, and $C_6$-hydrocarbons.

Next, a portion of the $C_6$-hydrocarbons are removed from at least a portion of the stabilizer vapor stream to form a HCl and $H_2$-rich stream. In an exemplary embodiment, $C_6$-hydrocarbons are removed from at least a portion of the stabilizer vapor stream using a separator and a chiller that are in fluid communication with each other. The stabilizer vapor stream is introduced to the separator. The separator is operating at separation conditions effective to form a net gas vapor that comprises HCl, $H_2$, and $C_5$-hydrocarbons. In an exemplary embodiment, the net gas vapor is introduced to the chiller. The net gas vapor is separated in the chiller at separation conditions effective to form a $C_5$-hydrocarbons-rich phase and the HCl and $H_2$-rich stream. In an exemplary embodiment, the chiller is mounted directly on the separator such that the $C_5$-hydrocarbons-rich phase returns back to the separator. The separator forms the net gas vapor and a liquid stream that comprises $C_2$- and $C_3^+$ hydrocarbons by separating the stabilizer vapor stream and the $C_5$-hydrocarbons-rich phase at the separation conditions. In an exemplary embodiment, a portion of the liquid stream is directed to a LPG stripper. The LPG stripper is operating at conditions effective to separate the portion of the liquid stream into a $C_2$-hydrocarbon-rich stream and a LPG stream that comprises $C_3$ and $C_4$ hydrocarbons. The HCl and $H_2$-rich stream is divided into a recycle portion and a treatment portion. The treatment portion of HCl and $H_2$-rich stream is directed to a scrubber for treatment with a caustic. Because only a portion of HCl and $H_2$-rich stream is being directed to the scrubber, less HCl is being treated than conventional processes and thus, less caustic is required for neutralizing the HCl. Therefore, caustic consumption can be reduced for the isomerization process.

In an exemplary embodiment, the recycle portion of the HCl and $H_2$-rich stream is introduced to a reactor in the isomerization reaction zone. The reactor contains an isomerization catalyst and is operating at isomerization conditions. The isomerization catalyst is contacted with the recycle portion of the HCl and $H_2$-rich stream to activate the isomerization catalyst by replenishing chloride removed from the surface of the isomerization catalyst, forming a chloride-promoted isomerization catalyst. Because the recycle portion of the HCl and $H_2$-rich stream is used to activate the isomerization catalyst, less chloride promoter is required for activating the isomerization catalyst. Therefore, chloride promoter consumption can be reduced for the isomerization process. Also, since $H_2$ is also contained in the recycle portion of the HCl and $H_2$-rich stream, less makeup hydrogen is required and hydrogen consumption is reduced. A feed stream containing paraffins is introduced to the reactor and contacts the chloride-promoted isomerization catalyst in the presence of hydrogen to isomerize the paraffins and form branched paraffins.

Referring to FIG. 1, a schematic depiction of an apparatus 10 for isomerization of paraffins is provided. The apparatus 10 is utilized for a paraffin isomerization process that converts normal paraffins to branched paraffins. The apparatus 10 comprises a reaction zone 12 and a stabilizing-scrubbing zone 14.

The reaction zone 12 and the stabilizing-scrubbing zone 14 include a reactor 18 and stabilizer 20 (e.g., distillation column), respectively, that are in fluid communication. A paraffin feed stream 22 containing normal or un-branched paraffins is passed through a dryer 24 for removing water and to form a dried paraffin feed stream 26. In one embodiment, the paraffin feed stream 22 is rich in $C_4$ hydrocarbons, such as n-butane and may also contain relatively small amounts of iso-butane, pentane, and heavier materials (e.g., $C_6^+$ hydrocarbons). In another embodiment, the paraffin feed stream 22 is rich in $C_5$ and/or $C_6$ hydrocarbons, such as normal pentane and normal hexane.

In an exemplary embodiment, a hydrogen-containing gas feed 28 is passed through a dryer 30 for removing water and is combined with the dried paraffin feed stream 26 to form a combined stream 32. The combined stream 32 is passed through a heat exchanger 34 and a heater 36. As illustrated and will be discussed in further detail below, a chloride promoter stream 38 (e.g., containing perchloroethylene or the like) is introduced to the combined stream 32 between the heat exchanger 34 and the heater 36, and a HCl and $H_2$-rich recycle stream 40 (e.g., containing about 0.1 weight percent (wt. %) or greater of HCl) is introduced to the combined stream 32 upstream from the heat exchanger 34. In an exemplary embodiment, the heat exchanger 34 and the heater 36 together heat the combined stream 32 to a temperature of from about 90 to about 210° C. for introduction to the reactor 18.

In an exemplary embodiment, the reactor 18 is a fixed-bed catalytic reactor operating at a temperature of from about 90 to about 210° C. and contains an isomerization catalyst that is activated by HCl from the HCl and $H_2$-rich recycle stream 40 and further, by the decomposition of chloride promoter from the chloride promoter stream 38 to form a high-activity chloride-promoted isomerization catalyst. Non-limiting examples of the isomerization catalyst include alumina catalyst, platinum aluminum catalyst, and the like that can be chlorinated. The chloride-promoted isomerization catalyst in the presence of hydrogen is effective to isomerize the normal paraffins to branched paraffins (e.g., iso-butane, branched pentane, branched hexane, or combinations thereof) to produce an isomerization reaction-zone effluent 42. The isomerization reaction-zone effluent 42 contains the branched and un-branched paraffins, other $C_7$-hydrocarbons, $H_2$, HCl, and possibly other chloride-containing compounds. The isomerization reaction-zone effluent 42 is passed through the heat exchanger 34 to cool the effluent 42 to a temperature of from about 65 to about 165° C.

The isomerization reaction-zone effluent 42 is then introduced to the stabilizer 20. The stabilizer 20 separates the isomerization reaction-zone effluent 42 into a product stream 44 and a stabilizer vapor stream 46. The stabilizer vapor stream 46 contains HCl, $H_2$, and $C_6$-hydrocarbons. The product stream 44 contains branched and un-branched paraffins and is removed from the stabilizing-scrubbing zone 14. A portion of the product stream 44 may be passed through a heater 45 and returned back to the stabilizer 20 as reflux.

In an exemplary embodiment, the stabilizer vapor stream 46 is passed through an air cooler 48 and a partial condenser 50 that together cool the stabilizer vapor stream 46 to a temperature of from about 30 to about 60° C. The stabilizer vapor stream 46 is then introduced to a separator 52 for separation together with a $C_5$-hydrocarbon-rich phase (e.g. from a chiller 82) as will be discussed in further detail below. A liquid stream 54 containing $C_2$- and $C_3^+$ hydrocarbons is removed from the separator 52 and is passed through a pump 56. A level controller 58 including a control valve 60 controls the flow of the liquid stream 54 being removed from the separator 52.

In an exemplary embodiment, the stabilizing-scrubbing zone 14 comprises an LPG stripper 74. As illustrated, the liquid stream 54 is divided into portions 75 and 76. The portion 75 of the liquid stream 54 is advanced to the stabilizer 20 for reflux. The portion 76 of the liquid stream 54 is introduced to the LPG stripper 74. A level controller 77 and control valve 78 control the amount of the portion 76 flowing into the LPG stripper 74. The LPG stripper 74 is operating at separation conditions effective to separate the portion 76 of the liquid stream 54 into a $C_2$-hydrocarbon-rich stream 80 and a LPG stream 81 that comprises $C_3$ and $C_4$ hydrocarbons. In an exemplary embodiment, the separation conditions of the LPG stripper 74 include a temperature of from about 65 to about 120° C. and a pressure of from about 1,000 to about 2,000 kPa. As illustrated, the $C_2$-hydrocarbon-rich stream 80 is combined with the stabilizer vapor stream 46 upstream from the air cooler 48 and the partial condenser 50 for introduction to the separator 52. The LPG stream 81 is removed from the stabilizing-scrubber zone 14 for storage or otherwise. As illustrated, a portion of the LPG stream 81 may be passed through a heater 70 and returned back to the LPG stripper 74 as reflux.

Volatiles including HCl, $H_2$, and $C_5$-hydrocarbons form a net gas vapor in the separator 52. In an exemplary embodiment, the separator 52 is operating at a pressure of from about 700 to about 2,100 kPa. In an exemplary embodiment, the net gas vapor enters a chiller 82 that is mounted directly on the separator 52. Alternatively, the chiller 82 may be positioned downstream from the separator 52. In an exemplary embodiment, the net gas vapor is cooled in the chiller 82 via indirect heat exchange with a refrigerant 83, e.g., propane or the like, to a temperature of from about −40 to about 5° C. In an exemplary embodiment, the net gas vapor in the chiller 82 is at a pressure of from about 700 to about 2,100 kPa. The net gas vapor is separated into a HCl and $H_2$-rich stream 62 and a $C_5$-hydrocarbons-rich phase. In an exemplary embodiment, the $C_5$-hydrocarbons-rich phase drops back into the separator 52 for separation with the stabilizer vapor stream 46 as discussed above. In an exemplary embodiment, the HCl and $H_2$-rich stream 62 comprises HCl present in an amount of about 0.1 wt. % or greater, such as about from 0.2 to 0.7 wt. %, and $H_2$.

As illustrated, a pressure controller 64 along with control valves 66 and 68 are used to divide the HCl and $H_2$-rich stream 62 into a recycle portion, i.e., the HCl and $H_2$-rich recycle stream 40, and a treatment portion 72, respectively. The HCl and $H_2$-rich recycle stream 40 is passed through a compressor 86. In an exemplary embodiment, the compressor 86 pressurizes the HCl and $H_2$-rich recycle stream 40 to a pressure of from about 1,700 to about 3,500 kPa. The HCl and $H_2$-rich recycle stream 40 is passed along from the compressor 86 and is combined with the combined stream 32 for introduction to the reactor 18 together with the chloride promoter stream 38. As discussed above, once introduced to the reactor 18, HCl from the from the HCl and $H_2$-rich recycle stream 40 and further from the decomposition of chloride promoter from the chloride promoter stream 38 contacts and activates the isomerization catalyst by replenishing chloride removed from the surface of the isomerization catalyst. Because the HCl and $H_2$-rich recycle stream 40 is used to activate the isomerization catalyst, less chloride promoter is required from the chloride promoter stream 38 for activating the isomerization catalyst.

The treatment portion 72 of the HCl and $H_2$-rich stream 62 is passed through a heat exchanger 98 for indirect heat exchange with a heat transfer fluid 100, such as steam. In an exemplary embodiment, the heat exchanger 98 heats the treatment portion 72 of the HCl and $H_2$-rich stream 62 to a temperature of from about 30 to about 70° C. The treatment portion 72 of the HCl and $H_2$-rich stream 62 is then passed to a scrubber 104. The scrubber 104 scrubs the treatment portion 72 of the HCl and $H_2$-rich stream 62 by neutralizing any HCl contained therein with a caustic 106 followed by counter flow contact with water 108 to form a neutralized stream 110 and a caustic waste stream 112.

Accordingly, methods and apparatuses for isomerization of paraffins have been described. The exemplary embodiments taught herein introduce an isomerization reaction-zone effluent from an isomerization reaction zone to a stabilizer. The isomerization reaction-zone effluent comprises HCl, $H_2$, branched and un-branched paraffins, and other $C_7$-hydrocarbons. The stabilizer separates the isomerization reaction-zone effluent into a product stream that comprises the branched and un-branched paraffins and a stabilizer vapor stream that comprises HCl, $H_2$, and $C_6$-hydrocarbons. A portion of $C_6$-hydrocarbons are removed from the stabilizer vapor stream using a separator and a chiller that are in fluid communication with each other. The separator and the chiller cooperate to separate the stabilizer vapor stream to form a HCl and $H_2$-rich stream. A treatment portion of the HCl and $H_2$-rich stream is directed to a scrubber for treatment with a caustic. Because only a portion of the HCl and $H_2$-rich stream is being directed to the scrubber, less HCl is being treated than conventional processes and thus, less caustic is required for neutralizing the HCl. A recycle portion of the HCl and $H_2$-rich stream is introduced to a reactor in the isomerization reaction zone. The reactor contains an isomerization catalyst that is contacted with the HCl and $H_2$-rich stream to form a chloride-promoted isomerization catalyst. Because the recycle portion of the HCl and $H_2$-rich stream is used to activate the isomerization catalyst, less chloride promoter is required for activating the isomerization catalyst.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A method for isomerization of paraffins, the method comprising the steps of:

separating an isomerization effluent into a product stream that comprises branched and un-branched paraffins and a stabilizer vapor stream that comprises HCl, $H_2$, and $C_6$-hydrocarbons;

separating the stabilizer vapor stream into a net gas vapor comprising HCl, $H_2$, and $C_5$-hydrocarbons and a liquid stream that comprises $C_2$- and $C_3^+$ hydrocarbon;

separating the net gas vapor into a $C_5$-hydrocarbons-rich phase and a HCl and $H_2$-rich stream in a chiller;

activating an isomerization catalyst using at least a portion of the HCl and $H_2$-rich stream to form a chloride-promoted isomerization catalyst, wherein at least the portion of the HCl and $H_2$-rich stream is directly recycled from separation of the net gas vapor to activating the isomerization catalyst; and contacting a paraffin feed stream with the chloride-promoted isomerization catalyst in the presence of hydrogen for isomerization of the paraffins.

2. The method of claim 1, wherein the step of separating the isomerization effluent comprises separating the isomerization effluent at a stabilizer temperature of from about 65 to about 165° C.

3. The method of claim 1, wherein the step of forming the net gas vapor comprises separating the stabilizer vapor stream and the $C_5$-hydrocarbons-rich phase at a separation temperature of from about 30 to about 60° C.

4. The method of claim 3, wherein the step of forming the net gas vapor comprises separating the stabilizer vapor stream and the $C_5$-hydrocarbons-rich phase at a pressure of from about 700 to about 2,100 kPa gauge.

5. The method of claim 1, further comprising the step of:

dividing the HCl and $H_2$-rich stream into a recycle portion and a treatment portion, wherein the step of activating comprises activating the isomerization catalyst using the recycle portion of the HCl and $H_2$-rich stream.

6. The method of claim 5, further comprising the step of:

neutralizing the treatment portion of the HCl and $H_2$-rich stream with a caustic.

7. A method of claim 6, further comprising the step of:

heating the treatment portion of the HCl and $H_2$-rich stream to a temperature of from about 30 to about 70° C. prior to the step of neutralizing.

8. The method of claim 1, wherein the step of separating the net gas vapor comprises separating the net gas vapor at a separation temperature of from about −40 to about 5° C.

9. The method of claim 1, wherein the step of separating the net gas vapor comprises separating the net gas vapor at a separation pressure of from about 700 to about 2,100 kPa gauge.

10. The method of claim 1, further comprising the step of:

separating at least a portion of the liquid stream into a $C_2$-hydrocarbon-rich stream and a LPG stream that comprises $C_3$ and $C_4$ hydrocarbons.

11. The method of claim 10, wherein the step of separating the at least a portion of the liquid stream comprises separating the at least the portion of the liquid stream at a separation temperature of from about 65 to about 120° C.

12. The method of claim 10, wherein the step of separating the at least a portion of the liquid stream comprises separating the at least the portion of the liquid stream at a separation pressure of from about 1,000 to about 2,000 kPa gauge.

13. The method of claim 10, further comprising the step of:

combining the $C_2$-hydrocarbon-rich stream with the stabilizer vapor stream to form a combined stream, and wherein the step of forming the net gas vapor comprises separating the combined stream and the $C_5$-hydrocarbons-rich phase into the net gas vapor and the liquid stream.

14. A method for isomerization of paraffins, the method comprising the steps of:

activating an isomerization catalyst in a reactor operating at isomerization conditions to form a chloride-promoted isomerization catalyst, wherein the isomerization catalyst is activated with HCl generated from a chloride promoter stream and from a HCl and $H_2$-rich recycle stream;

contacting a paraffin feed stream comprising un-branched paraffins with the chloride-promoted isomerization catalyst in the reactor in the presence of hydrogen to form an isomerization effluent comprising branched paraffins, HCl, $H_2$, and other $C_7$-hydrocarbons;

introducing the isomerization effluent to a stabilizer at stabilization conditions to form a product stream that comprises branched and un-branched paraffins and a stabilizer vapor stream that comprises HCl, $H_2$, and $C_6$-hydrocarbons;

separating the stabilizer vapor stream in a separator at first separation conditions into a net gas vapor that comprises HCl, $H_2$ and $C_5$-hydrocarbons and a liquid stream that comprises $C_2$- and $C_3^+$ hydrocarbons;

separating the net gas vapor in a chiller at second separation conditions into a $C_5$-hydrocarbons-rich phase and a HCl and $H_2$-rich stream; and directly recycling at least a portion of the HCl and $H_2$-rich stream back to the reactor as the HCl and $H_2$-rich recycle stream.

15. The method of claim 14, further comprising the steps of:

dividing the HCl and $H_2$-rich stream into a recycle portion and a treatment portion, wherein the step of recycling comprises recycling the recycle portion of the HCl and $H_2$-rich stream back to the reactor; and introducing the treatment portion of the HCl and $H_2$-rich stream to a scrubber to neutralize HCl with a caustic.

16. The method of claim 14, wherein the step of separating the net gas vapor comprises introducing the net gas vapor to the chiller for indirect heat exchange with a refrigerant.

17. The method of claim 16, wherein the step of introducing the net gas vapor comprises cooling the net gas vapor to a temperature of from about −40 to about 5° C.

18. The method of claim 14, further comprising the step of:

separating at least a portion of the liquid stream in a LPG stripper at third separation conditions into a $C_2$-hydrocarbon-rich stream and a LPG stream that comprises $C_3$ and $C_4$ hydrocarbons.

19. The method of claim 18, further comprising the step of: introducing the $C_2$-hydrocarbon-rich stream to the stabilizer vapor stream upstream of the separator to form a combined stream, and wherein the step of forming the net gas vapor comprises separating the combined stream and the $C_5$-hydrocarbons-rich phase in the separator into the net gas vapor and the liquid stream.

* * * * *